US007169038B1

(12) United States Patent
Vignau

(10) Patent No.: US 7,169,038 B1
(45) Date of Patent: Jan. 30, 2007

(54) LOUVERED SCREEN APPARATUS FOR OVERHEAD AND ROLL-UP DOORS

(76) Inventor: Mike Vignau, 7501 Palma Ave., Hughson, CA (US) 95326

( * ) Notice: Subject to any disclaimer, the term of this patent is extended or adjusted under 35 U.S.C. 154(b) by 555 days.

(21) Appl. No.: 10/410,057

(22) Filed: Apr. 8, 2003

(51) Int. Cl.
*E06B 7/02* (2006.01)

(52) U.S. Cl. ..... 454/195; 454/333

(58) Field of Classification Search ..... 454/333, 454/195, 250
See application file for complete search history.

(56) References Cited

U.S. PATENT DOCUMENTS 2,000,366 A * 5/1935 Victor ..... 160/92
4,662,270 A * 5/1987 Fiddler et al. ..... 454/195
4,770,087 A * 9/1988 Danley et al. ..... 454/195
5,716,270 A * 2/1998 Chambers ..... 454/332

* cited by examiner

*Primary Examiner*—Derek S. Boles

(57) ABSTRACT

A screen device is disclosed for attaching to, or making an overhead or roll-up door, one example being a garage door. The device is disclosed as an apparatus that is installed as a single or multiple units within or attached to a door, the apparatus comprising (1) a frame; (2) a louver mechanism attached to the frame, the louver of approximately the same size and shape as the frame, the louver mechanism operable to rotate open and close against the frame; (3) an opener for attaching the louver mechanism to the frame, and for maintaining the louver mechanism at a desired position of opening; and, (4) a screen or mesh immovably attached to the frame, and positioned relative to the louver mechanism so that the screen is obscured and shielded by the louvers of the louver mechanism, and when the louver is opened, the screen or mesh is revealed, and whereby the screen filters out objects that impinge upon the opening left by the frame, yet permit light and air to pass.

5 Claims, 10 Drawing Sheets

LOUVERED SCREEN APPARATUS FOR OVERHEAD AND ROLL-UP DOORS

FIELD OF THE INVENTION

The present invention is related to screens and other devices for selective occlusion of doors to rooms or buildings; more specifically herein is disclosed a louvered screen apparatus for attaching to an overhead or roll-up door, the purpose of which is to permit sunlight and air while preventing entry of insects, dust, leaves and other unwanted objects and materials.

BACKGROUND

Overhead and roll-up doors have multiple uses, serving primarily as a means for permitting entry into garages, loading docks, trucks, warehouses, recreational and work spaces, or any room or building that must accept entry of large objects, such as vehicles; any object that must be secured by a door that is closed and locked.

For example, in the case of residences, garages are multi-purpose rooms requiring a means permitting and preventing entry. In addition to housing vehicles, garages store household items and quite often serve double-duty as workshops and recreation rooms. While being used for these purposes, garage doors are kept open to let in air and sunlight. However, quite often, traditional overhead or roll-up doors let more than clean air and sunlight in. Unwanted dust, dirt, and insects are often found in garages, having entered through an open garage door. Similar, unwanted intrusion is found in warehouses, loading docks, trucks and other similar kinds of enclosures.

Clearly, a means for permitting desired items and filtering out those that are unwanted becomes a desirable objective for any kind of room or building requiring an overhead or roll-up door. It will be appreciated, for example, that a means for securing a door, yet permitting entry of circulating air, while keeping out dust and dirt will be advantageous. Furthermore such a securing means will permit pets to be kept in an enclosure, which, otherwise, would be too hot and would not permit adequate air to circulate to enclosed animals.

SUMMARY

Therefore, in response to the efficacy and utility of a selective filter for buildings or rooms requiring large overhead or roll-up doors, a novel and useful apparatus is disclosed; the apparatus permitting entry of air and light, and at the same time prohibiting entry of unwanted objects and materials, and not compromising security provided by the door. Herein is disclosed an apparatus that is installed as a single unit or as multiple units made part of, or attached to, an overhead door, the apparatus fitted to an opening made in a door. The apparatus comprises (1) a frame; (2) a louver device attached by a opener to the frame, the louver device operable to rotate consistent with the constraint imposed by the opener and, thereby to open and close against the frame. The apparatus is further provided with (3) a screen comprising a mesh, porous or a transparent material immovably affixed to the frame, and positioned relative to the louver so that the screen is obscured, covered and shielded by the louver when the louver device is closed. When the louver device is opened, the screen or mesh is revealed, whereby the screen or mesh filters out objects that impinge upon the opening left by the louver device, yet the screen or mesh permits light and air to pass.

The apparatus will be seen to have a number of benefits and advantages, the first benefit being that the apparatus is modular and therefore can be added or installed in increments to satisfy the user with regard to the amount of light and circulating air that is desired.

A second benefit is that the apparatus is lightweight and therefore does not add to the weight of an overhead door.

A third benefit or advantage is that because of the modular construction and materials used, the apparatus can be made inexpensively.

Another benefit is that the apparatus can be added to a door after the door is manufactured and installed, and used in lieu of some or all of the panels of an overhead or roll-up door.

And yet another benefit is that the apparatus can be made in different sizes and even in different colors to match the differing styles of existing garage doors.

Another benefit is the apparatus will provide the means by which animals can be enclosed without detrimental effects.

These benefits and advantages plus others will be seen from an analysis and examination of the drawings and description that follow.

DETAILED DESCRIPTION

An Exemplary Embodiment

Figure 1:
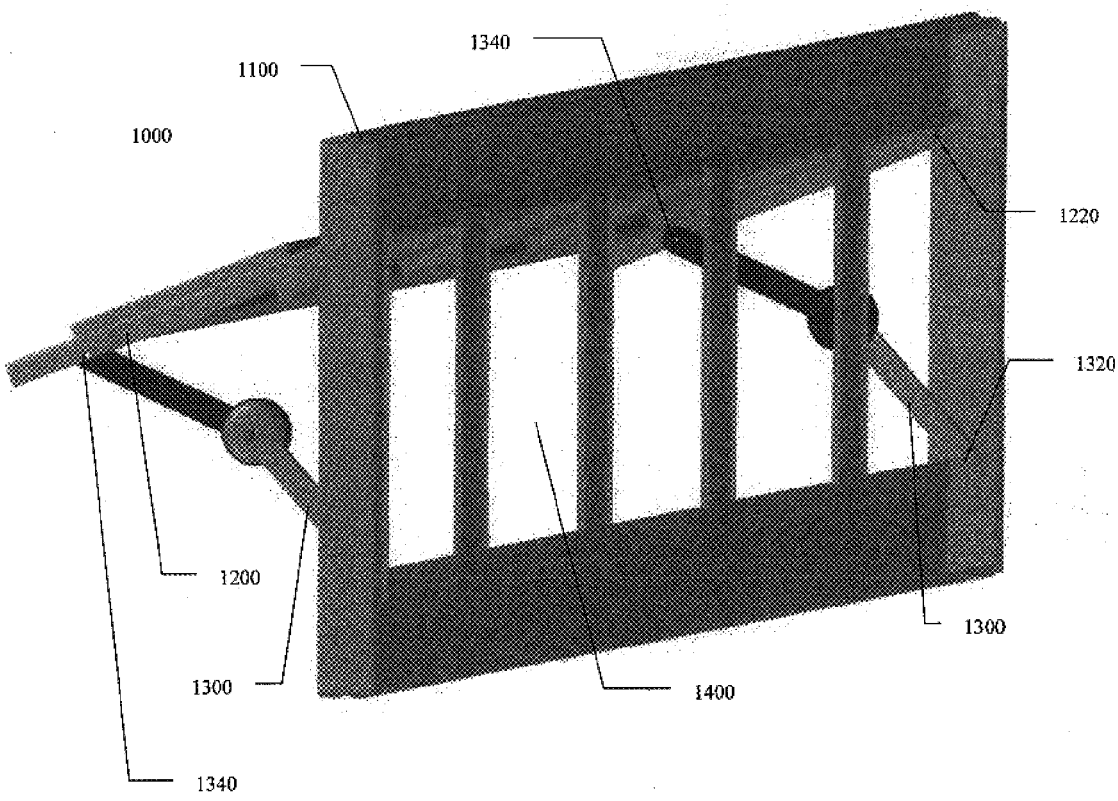
In FIG. 1, the apparatus 1000 is shown, in an exemplary embodiment, the apparatus comprising a frame 100, a louver device 1200 rotatably attached to the frame by two openers 1300. One end 1320 of each of the openers 1300 is attached to the frame 1100, while the other end 1340 of each of the openers 1300 is attached to the louver device 1200. The frame is optionally furnished with a screen or mesh 1400, which is indicated in FIG. 1, but is now shown for clarity.

With reference to FIG. 1, the apparatus 1000 is shown in an exemplary embodiment comprising a frame 1100, a louver device 1200 rotatably attached to the frame by two openers 1300. The louver device 1200 is attached to the frame 1100 at the point of attachment 1220.

The same end 1320 of each of the openers 1300 is attached to the frame 1100, while the other end 1340 of each of the openers 1300 is attached to the louver device 1200.

The end of the louver device 1300 that is distal from the attachment 1340 of the louver device 1200 to the opener 1300 is rotatably attached to the frame 1100 at the point of attachment 1320. One possible means of attachment 1320 is a pin that constrains the opener 1300, while operating, to rotate about the point of attachment by the pin at the point of attachment 1320. However, any means of attachment may be used so long as the means does not prevent the rotation of the lover device 1200.

Any suitable means of attachment of a opener 1300 to the louver device 1200 may be used, so long as the louver device 1200 is free to rotate about the point of attachment 1340.

While two openers 1300 have been shown, it will be appreciated that only one opener 1300 could be used in the apparatus 1000.

Operation of the Exemplary Embodiment

The louver device 1200 is opened and shut by applying an outward force to a handle of the opener 1300. When a force is so applied, the end of the louver device where the force is applied responds by rotating in a general direction of the applied force, with rotation about each of the points of attachment 1320. When the louver device 1200 is rotated, each of the openers 1300 fold into the frame, as will be seen by the following description.

Figure 2:
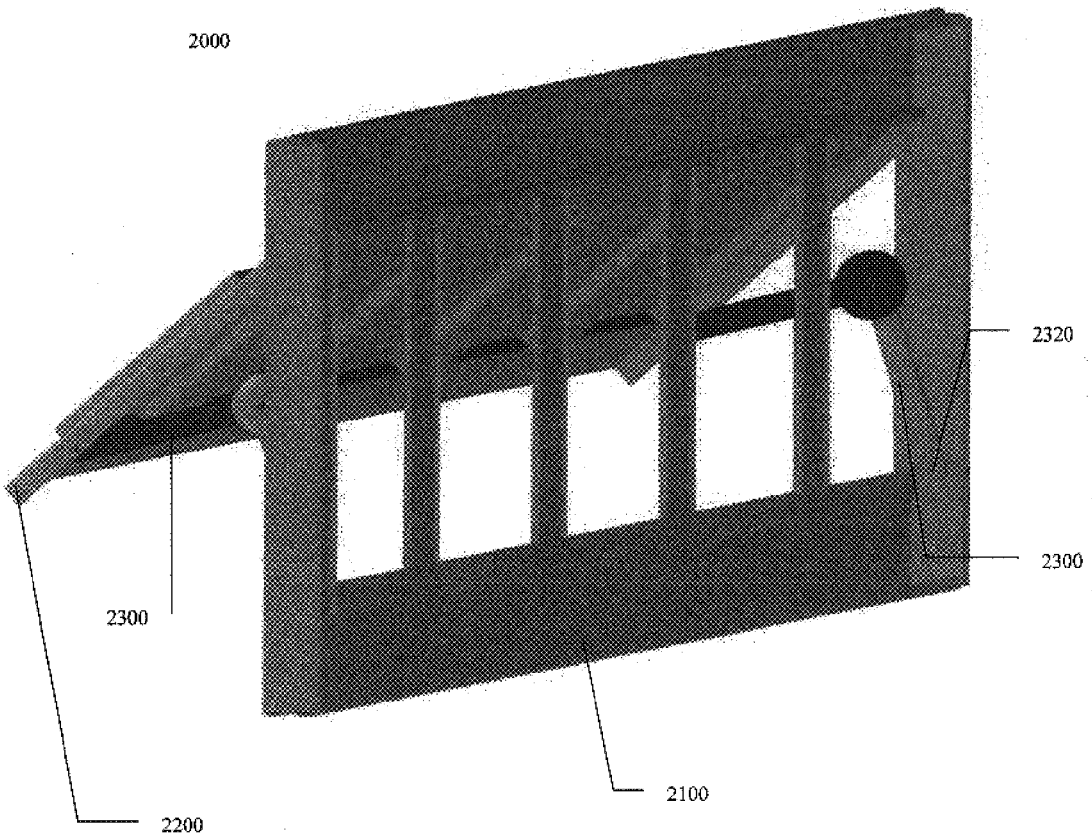
FIG. 2 shows a first embodiment apparatus, wherein the louver device 2200 is being closed against the frame 2100.

With reference to FIG. 2, the apparatus 2000 is shown again, wherein the louver device 2200 has rotated with respect to the frame 2100. Each of the two openers 2300 operate to constrain the louver device 2200 to rotate around the point of attachment 2120 of the louver device 2200 to the frame 2100.

Figure 3:
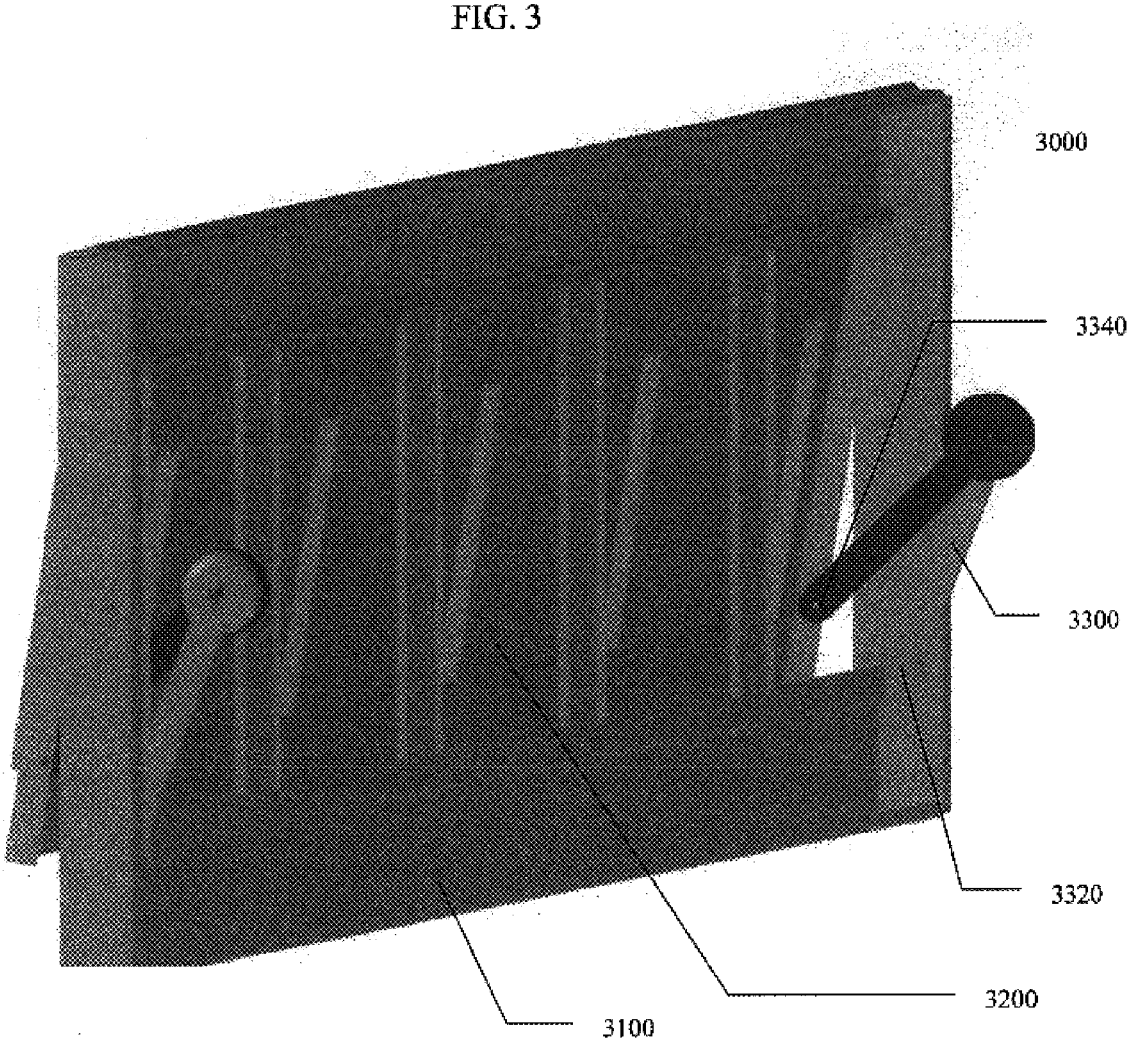
In FIG. 3 of the first embodiment, the louver device 3200 is closed further.

With reference to FIG. 3, the apparatus 3000 is shown again, wherein the louver device 3200 has further rotated with respect to the frame 3100. Each of the two openers 3300 operates to constrain the louver device 3200 to further rotate around the point of attachment 3120 of the louver device 3200 to the frame 3100.

Figure 4:
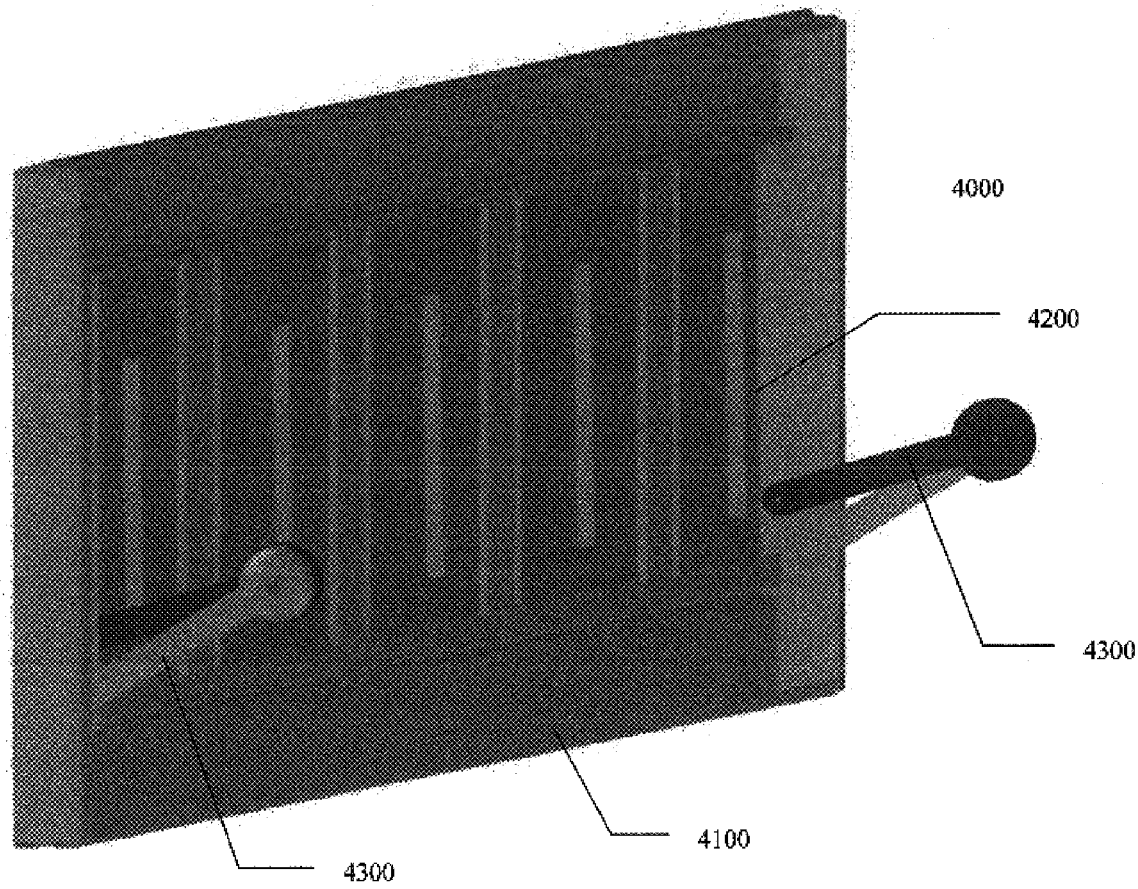
In FIG. 4 of the first embodiment, the louver device 4200 is shown completely closed against the frame 4100.

With reference to FIG. 4, the apparatus 4000 is shown with the louver device 4200 closed against the frame 4100, wherein the louver device 4200 has further rotated with respect to the frame 4100, the rotation stopped by the louver device 4200 constrained from further rotation by the frame 4100. Each of the two openers 4300 operates to constrain the louver device 4200 to rotate around the point of attachment 4120 of the louver device 4200 to the frame 4100.

Opener

Figure 5A:
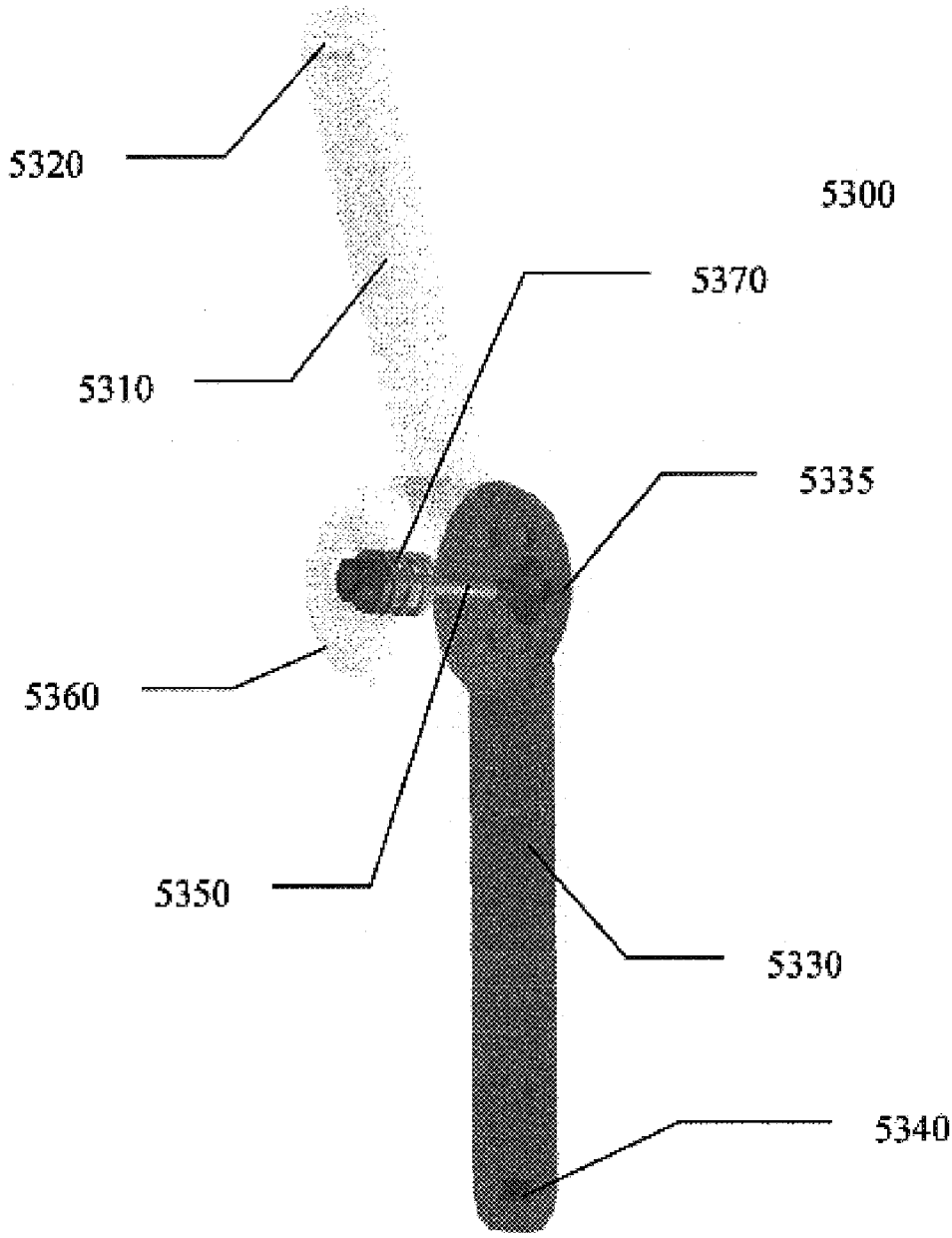
In FIGS. 5A–5B, details of the opener 5300 in the first embodiment is shown.

With reference to FIG. 5A, an embodiment 5300 of the opener is shown. In the embodiment, the opener 5300 is shown comprising two handles 5310 5330. Handle 5310 is attached to the frame (not shown) at the point of attachment 5320. Handle 5330 is attached to the frame at the point of attachment 5340. Attachments are made so that the handles 5310 5330 are free to rotate about the point of attachments 5320 5340, with further constraint provided by the attachment of each of the opener arms 5310 5330 each to the other.

Figure 5B:
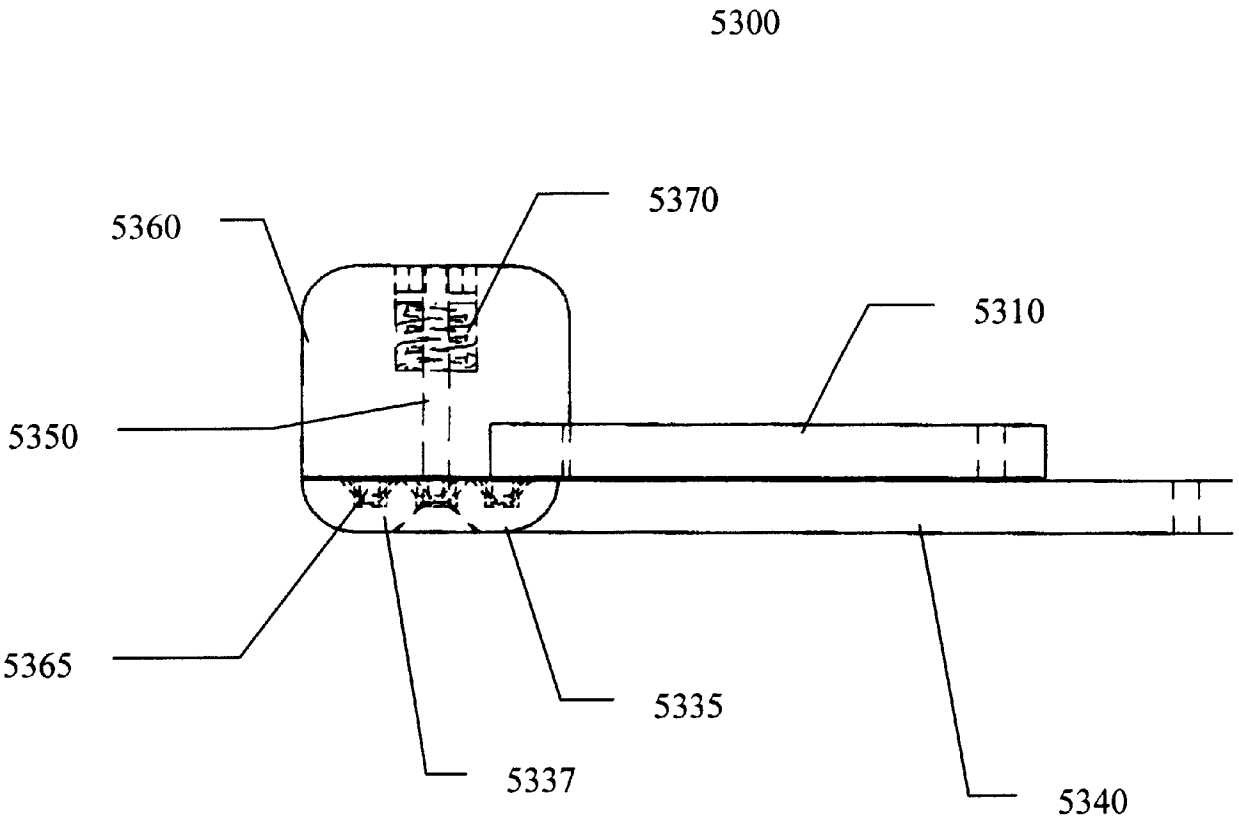

With reference to FIG. 5B, the first handle 5330 has a receiver 5335. The receiver has detents 5337. The second handle 5310 has a cylindrical body 5360, which has projections 5365 that engage the detents 5337. The cylindrical body 5360 is rotatably attached to the receiver 5335 by a bolt 5350. A spring 5370 is attached to bolt 5350 and made so the spring 5370 applies force to separate the cylindrical body 5360 and the receiver 5335. As the opener rotates about the bolt 5350, the projections 5365 move into and out of the detents 5337 to provide multiple opened positions. When the projections 5365 are engaged in the detents 5337, the spring 5370 is lengthened. When the opener is rotated so that the projections 5365 rise out of the detents 5337, the spring 5370 is shortened creating a counter force by the spring 5370 against the rotation. By tightening or loosening the bolt 5350, the opener can be adjusted so that an optimum force will be required to open and close the louver.

It will be appreciated that if the louver is open and the garage door is opened, the louver will bump against the garage door frame, causing the opener to rotate, permitting the louver to close.

Again referencing FIG. 5A, the handle 5330 is rotatably attached to handle 5310 by the hinge bolt 5350. Handle 5310 has a cylindrical body 5360, which encloses the hinge bolt 5350.

The receiver 5335 accepts the hinge bolt 5350 by a hole drilled in the handle cylinder receiver 5335. The hole drilled in the receiver 5335 has threads, which receive and hold the hinge bolt 5350.

A hole is also drilled in the cylindrical body 5360. The hole accepts the bolt 5350 and is of sufficient diameter to permit the cylindrical body 5360 to rotate about the bolt 5350.

The hinge bolt 5350 is passed through the hole drilled in the cylindrical body 5360, and screwed into the threads in the receiver 5335, the handle cylinder 5360 is received by the cylinder receiver 5335. The receiver 5335 and the cylindrical body 5360 are attached so that the cylindrical body 5360 may rotate about the hinge bolt 5350.

Further referencing FIG. 5A, the first embodiment of the opener 5300 has a spring 5370. The spring provides tension, by which the projections of the cylindrical body acting in concert with the detents of the receiver maintain the opener at a specific desired position when manipulated.

In this embodiment, one end 5370 of the spring is attached to the bolt 5350. The other end of the spring 5370 engages the cylindrical body 5360. When handle 5310 is rotated with t to handle 5330, the projections rise from the detents to produce a counter force against that of the spring.

Mounting

Figure 6:
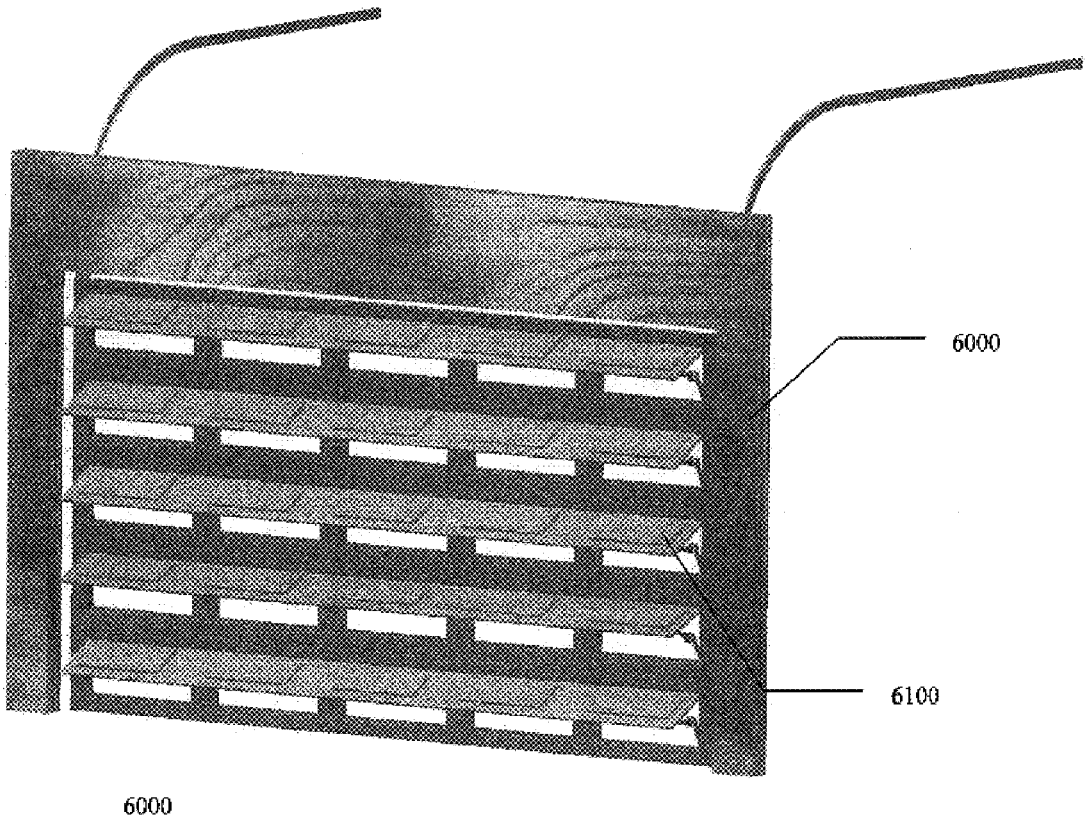
In FIG. 6, a plurality of apparatus are shown, from the outside, deployed in a garage door. Each apparatus is shown open, however, it will be appreciated from the description that each apparatus can be operated independently.

With reference to FIG. 6, a plurality of the apparatus 6100 is shown mounted, and open, in a garage door 6000, which is shown closed. FIG. 6 shows the apparatus 6100 as viewed from outside the garage.

It will be appreciated that a single apparatus is mounted in a garage or roll-up door by making an opening in the door, the opening made or cut only slightly larger than the size of the frame of the apparatus. The frame is then attached to the garage door by fasteners, such as screws, or by adhesives. By repeating this operation a plurality of the apparatus can be similarly attached to a door.

Figure 7:
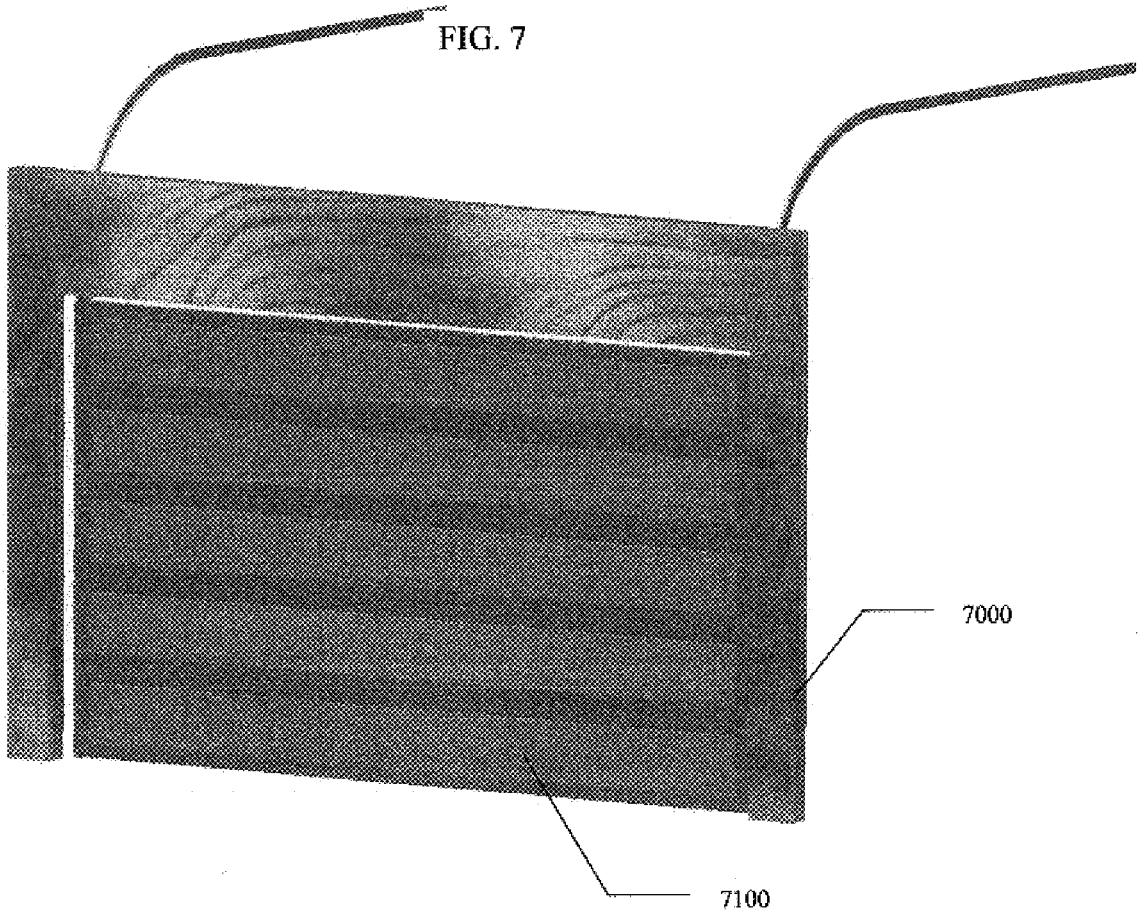
In FIG. 7, a plurality of the apparatus are shown from the outside, and closed in a garage door, which is shut.

With reference to FIG. 7, a plurality of the apparatus 7100 is shown mounted, and closed, in a garage door 7000. FIG. 7 shows the apparatus 7100 as viewed from outside the garage.

Figure 8:
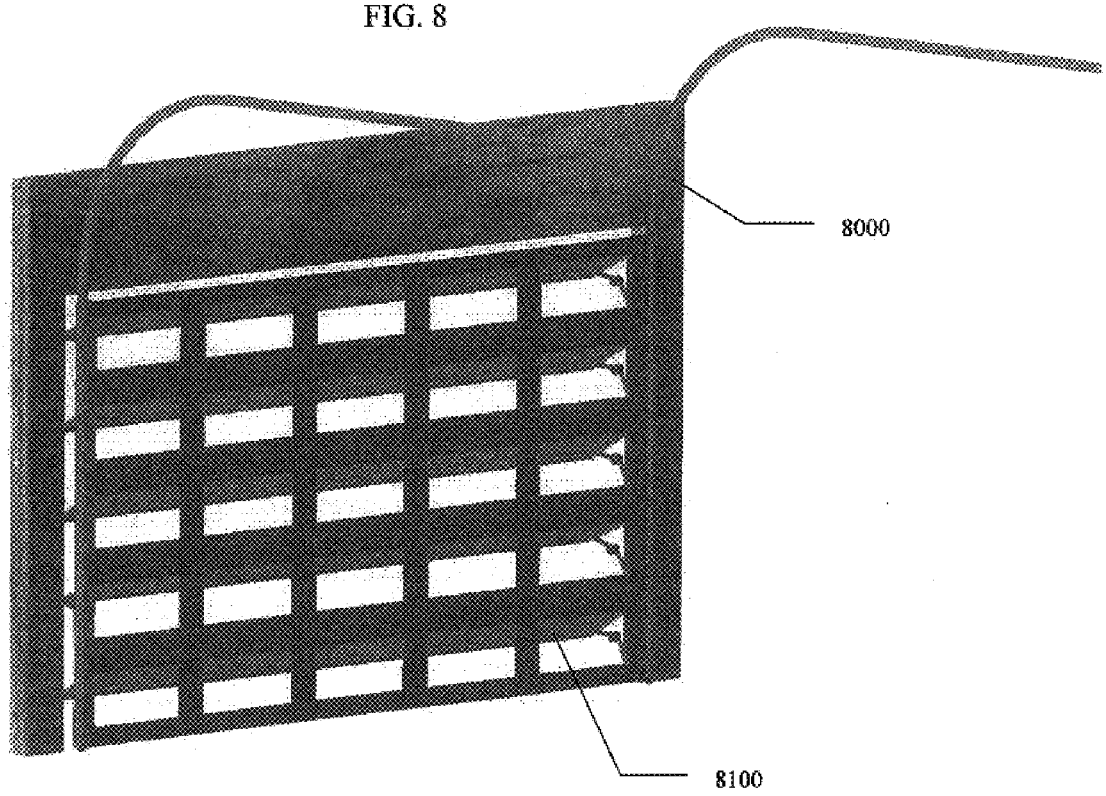
In FIG. 8, a plurality of apparatus are shown, from the inside, deployed in a garage door. Each of the apparatus is shown open, however, it will be appreciated from the description that each apparatus can be operated independently.

With reference to FIG. 8, a plurality of the apparatus 8100 is shown mounted, and open, in a garage door 8000. FIG. 8 shows the apparatus 8100 as viewed from outside the garage.

Figure 9:
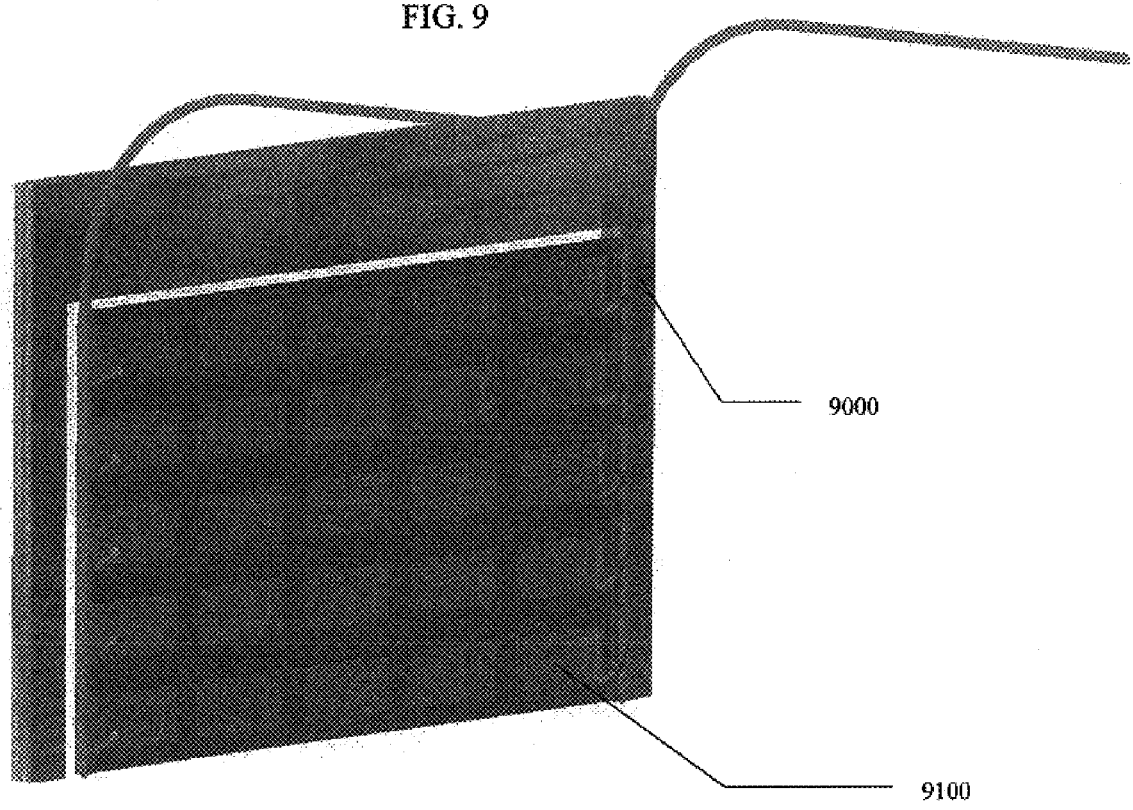
In FIG. 9, a plurality of the apparatus are shown, from the inside, closed in a garage door.

With reference to FIG. 9, a plurality of the apparatus 9100 is shown mounted, and closed, in a garage door 9000. FIG. 9 shows the apparatus 9100 as viewed from outside the garage.

DISCLOSURE SUMMARY

The invention has been disclosed in a single embodiment Although the invention has been illustrated with reference to a specific embodiment, it is not intended that the invention be limited to the embodiment illustrated. Those skilled in the art will recognize that variations and modifications can be made without departing from the spirit and scope of the invention. Therefore, it is intended that this invention comprises all the variations and modifications encompassed by the following claims.

I claim:

1. An apparatus for attaching to a garage door, the apparatus permitting air to enter though the garage door when closed, the apparatus comprising:

a frame, the frame fitted to an opening made in the garage door, the frame having an opener, wherein the opener comprises a first arm and a second arm rotatably attached, the first arm having a plurality of projections, the second arm having a plurality of detents for receiving the projections, the opener further having a spring operational to maintain the projections in the detents, whereby the first arm is rotated with respect to the second arm by applying a counter force to the spring through either the first arm of the second arm; and a louver attached to the frame and to the opener, the louver parallel and adjacent to the frame when the louver is closed;

whereby the louver is opened permitting air to enter through the frame and into the garage when the garage door is closed.

2. An apparatus for attaching to a door, the apparatus permitting air to enter though the door when closed, the apparatus comprising:

a frame, the frame fitted to an opening made in the door, the frame having an opener, wherein the opener comprises a first arm and a second arm rotatably attached, the first arm having a plurality of projections, the second arm having a plurality of detents for receiving the projections, the opener further having a pressure-producing means operational to maintain the projections in the detents, whereby the first arm is rotated with respect to the second arm by applying a counter force to the pressure-producing means through either the first arm of the second arm; and a louver attached to the frame and to the opener, the louver parallel and adjacent to the frame when the louver is closed;

whereby the louver is opened permitting air to enter through the frame when the door is closed.

3. A method for permitting air to circulate through a door, when said door is closed, the method comprising:

making an opening in the door;

fitting and attaching a frame in the opening;

attaching an opener to the frame, wherein the opener comprises a first arm and a second arm rotatably attached, the first arm having a plurality of projections, the second arm having a plurality of detents for receiving the projections, the opener further having a spring operational to maintain the projections in the detents, whereby the first arm is rotated with respect to the second arm by applying a counter force to the spring through either the first arm of the second arm; and attaching a louver to the frame and to the opener;

whereby the louver is opened to permit air to circulate through the door.

4. The method of claim 3, wherein the door is a garage door.

5. The method of claim 3, wherein the door is a roll-up door.

* * * * *